US008726469B1

(12) United States Patent
Delaneau

(10) Patent No.: US 8,726,469 B1
(45) Date of Patent: May 20, 2014

(54) ARTICLE OF BUTTON JEWELRY

(76) Inventor: Jacqueline Delaneau, Honolulu, HI (US)

( * ) Notice: Subject to any disclaimer, the term of this patent is extended or adjusted under 35 U.S.C. 154(b) by 0 days.

(21) Appl. No.: 13/536,984

(22) Filed: Jun. 28, 2012

Related U.S. Application Data

(63) Continuation-in-part of application No. 12/570,879, filed on Sep. 30, 2009, now abandoned.

(60) Provisional application No. 61/102,436, filed on Oct. 3, 2008.

(51) Int. Cl.
*A44B 1/00* (2006.01)
*A44B 1/04* (2006.01)
*A44C 25/00* (2006.01)

(52) U.S. Cl.
USPC ..... 24/113 R; 24/113 MP; 63/33

(58) Field of Classification Search
USPC ..... 63/28, 33; 24/113 R, 113 MP
See application file for complete search history.

(56) References Cited

U.S. PATENT DOCUMENTS

| | | | | |
|---|---|---|---|---|
| 573,139 | A | 12/1896 | Costigan | 63/28 |
| 1,747,322 | A * | 2/1930 | Riker | 24/113 R |
| 2,350,714 | A | 6/1944 | Bazner | 63/33 |
| 2,377,688 | A | 6/1945 | Hubbell | 63/20 |
| 2,850,779 | A | 9/1958 | Dobro | 40/315 |
| 3,353,231 | A * | 11/1967 | Levine | 24/113 R |
| 3,934,313 | A * | 1/1976 | Hocq | 24/113 MP |
| 1,908,469 | A | 5/1993 | Aanerud | 24/518 |
| 5,621,951 | A | 4/1997 | Gould | 24/90.5 |
| 6,026,515 | A | 2/2000 | Nielson et al. | 2/244 |
| 6,070,434 | A | 6/2000 | Traver | 63/1.11 |
| 6,098,202 | A | 8/2000 | Peck | 2/244 |
| 6,769,270 | B2 | 8/2004 | Takessian | 63/29.1 |
| 6,857,167 | B2 | 2/2005 | Bishop | 24/66.2 |
| 2004/0006849 | A1 | 1/2004 | Bishop | 24/3.4 |
| 2012/0117763 | A1 * | 5/2012 | Patel | 24/102 SL |

* cited by examiner

*Primary Examiner* — Victor Batson
*Assistant Examiner* — Emily Morgan
(74) *Attorney, Agent, or Firm* — L.C. Begin & Associates, PLLC.

(57) ABSTRACT

An article for covering a button of apparel is provided. The article includes a body portion and a coupling member secured to the body portion. The coupling member includes a pair of opposed resiliently deflectable portions structured to deflect responsive to insertion of a neck of a button therebetween.

6 Claims, 14 Drawing Sheets

ARTICLE OF BUTTON JEWELRY

CROSS-REFERENCE TO RELATED APPLICATIONS

This application is a continuation-in-part of U.S. application Ser. No. 12/570,879, filed on Sep. 30, 2009 now abandoned, which claims the benefit of U.S. Provisional Application No. 61/102,436 filed on Oct. 3, 2008. These prior applications are incorporated herein by reference.

TECHNICAL FIELD

The present disclosure generally relates to buttons, and, more particularly to an article for covering and accessorizing buttons.

BACKGROUND OF THE INVENTION

In today's fashion-conscious world, people may wear apparel and adorn themselves in a manner to project confidence, success and personal style. A variety of stylized clothes are worn by people to enhance their appearance. In addition, various accessories may be worn to accentuate that appearance. It is desirable to be able to easily tailor and change the appearance of such accessories, according to the needs of particular personalities and situations.

SUMMARY OF THE INVENTION

In one aspect of the embodiments of the present invention, an article for covering a button of apparel is provided. The article includes a body portion and a coupling member secured to the body portion. The coupling member includes a pair of opposed resiliently deflectable portions structured to deflect responsive to insertion of a neck of a button therebetween.

BRIEF DESCRIPTION OF THE DRAWINGS

The advantages and features of the present disclosure will become better understood with reference to the following detailed description and claims taken in conjunction with the accompanying drawings, in which:

DETAILED DESCRIPTION

Figure 1:
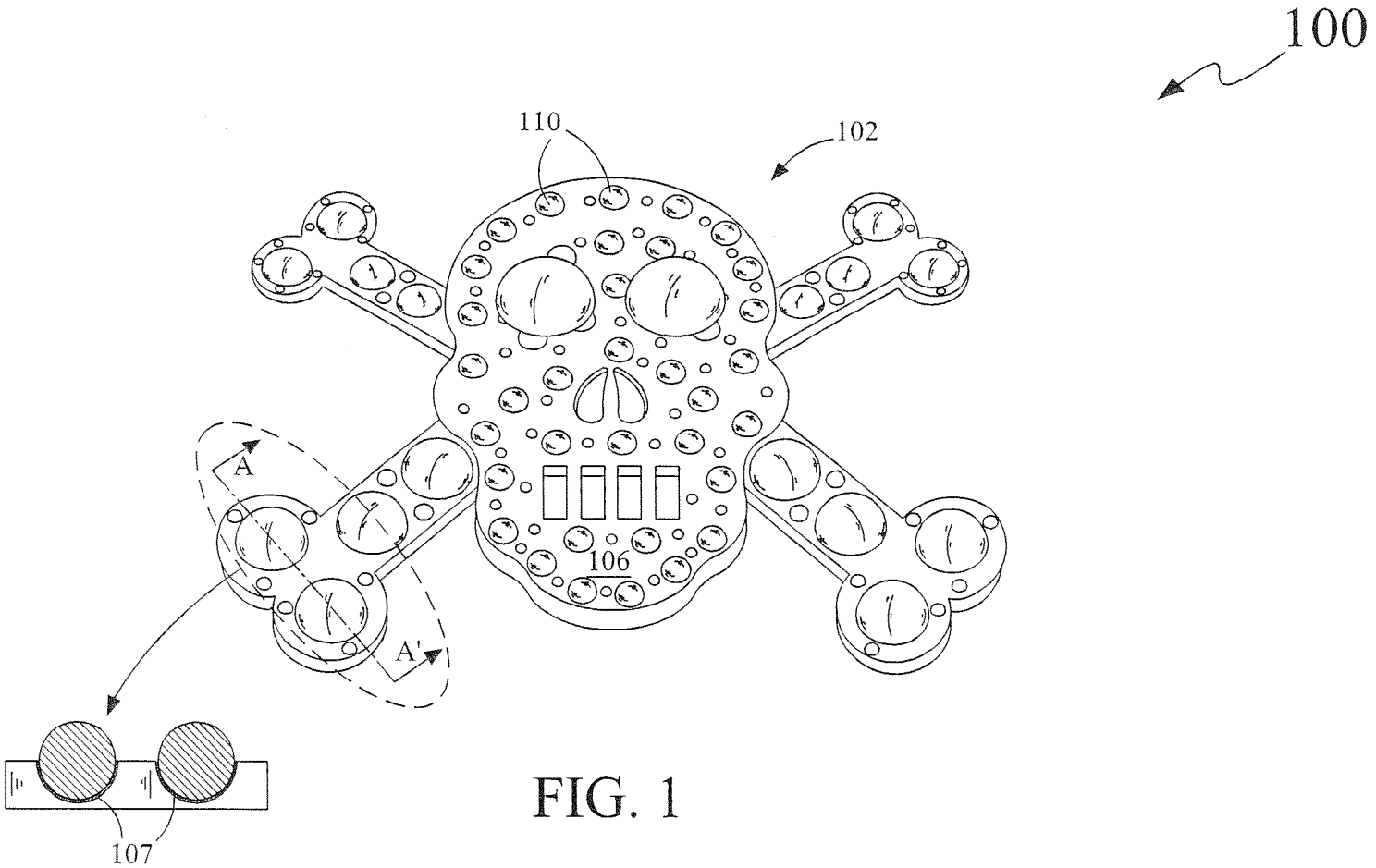
FIG. 1 is a front view of one embodiment of an article of button jewelry incorporating a mechanism in accordance with one embodiment of the present invention for attaching the article to a button.

Like reference numerals refer to like parts throughout the description of several views of the drawings.

The present disclosure provides an article of button jewelry and also a mechanism for removably attaching button jewelry to a button of apparel for covering the button. Examples of the apparel include, but are not limited to, capris, pants and jeans. As used herein, the "head" of a button refers to the body of the button itself. Also, as used herein, a "neck" of a button refers to the threads or other mechanism by which the button is attached to an article of clothing, and which resides between the head of the button and the clothing article.

Referring to FIGS. 1-4 and 7-13, one embodiment of an article of button jewelry 100 may include a front piece 90 having a front face 90*a* and a mounting face 90*b*. In the embodiment shown in FIG. 1, face 90*a* has a plurality of stones 110 mounted thereon, which in this form may include one or more gems, rhinestones, pearls, rubies, sapphires, emeralds, garnets, topazes, chatons, diamonds, or any combination thereof. Further, the stones 110 may belong to various varieties, such as precious stones, semi-precious stones, artificial stones, the like or any combination thereof. Of course, the stones may be made of other suitable materials including, for example, smooth or satin finish metals. Alternatively, front piece 90 may include any of a variety of other decorative features mounted thereon, as desired or as dictated by the requirements of a particular use of application.

Front piece 90 may be formed from a metallic material, a polymeric material, or any other suitable material. Mounting face 90*b* may incorporate features formed integrally with the front piece to facilitate mounting of the jewelry article 100 on a button, belt or other article of clothing. Alternatively, a separate piece or body portion 102 incorporating the mounting features may be attached to the mounting face 90*b*, as described in greater detail below. This enables attachment of the body portion incorporating the mounting features to be affixed to a separately formed piece of jewelry, a belt buckle type design, a brooch design or any other jewelry an artist would see fit to create as part of front piece 90.

The stones 110 may be held within associated seats 107 formed in front face 90*a* by forming or wrapping one or more surfaces of the front face around the stone 110. However, the stones 110 may be held within the seat by other suitable methods. Further, the seats 107 may be arranged in any desired pattern on the front face.

Referring to FIGS. 1-4 and 7-13, the button jewelry 100 may also include a body portion 102. In the embodiment shown in FIGS. 1-4 and 7-13, body portion 102 has a first side 102*a* suitable for attachment to mounting face 90*b* of front piece 90, and a second side 102*b* opposite the first side, on which features suitable for mounting of a coupling member 104 thereon.

In one embodiment, the edges of body portion 102 define the same outer shape as front piece 90. For example, in the embodiment shown in FIGS. 1-4 and 7-13, the body portion 102 has a shape of a skull and cross bone combination, and the outer edges of the body portion conform (or substantially conform) to the outer edges of the front piece. Alternatively, the body portion 102 may have any shape suitable for attachment to mounting face 90*b* of front piece 90. In addition, the body portion may be sized such that most or the entire body portion 102 is obscured from view when the jewelry article front face 90*a* is viewed in the direction "E" shown in FIG. 13.

In one embodiment, body portion 102 is formed integrally with front piece 90. In this embodiment, the coupling member or fastener 104 (described in greater detail below) used to attach the jewelry article to a button or other article of clothing is mounted to the integrally-formed body portion/front piece.

In another embodiment, body portion 102 is formed as a piece separate from front piece 90. This enables a suitably sized and/or shaped body portion to be attached to a suitable front piece to convert the front piece to a jewelry item attachable to a button or item of clothing wearable by a user.

Body portion 102 has a first side 102*a* structured for attachment to mounting face 90*b* of front piece 90, using adhesives, mechanical fasteners, or any other suitable method.

Referring to FIGS. 1-4 and 7-13, body portion second side 102*b* has a plurality of securing members disposed therealong. In the embodiment shown, first, second, and third securing members 103*a*, 103*b*, and 103*c* are provided, and are positioned along second side 102 so as to form a triangular arrangement. However, other numbers and arrangements of securing members are also contemplated.

In the embodiment shown, first securing member 103*a* has a pair of opposed, resiliently deflectable arms defining a slot 111 in communication with a recess 113 structured for receiving therein a first portion 104*a* of coupling member 104 (described below). Second securing member 103*b* has an associated cavity 124 formed therein and structured for receiving therein an associated portion 104*b* of coupling member 104, in the manner described below. Similarly, third securing member 103*c* has an associated cavity 126 formed therein and structured for receiving therein an associated portion 104*c* of coupling member 104, in the manner described below.

In one embodiment, at least one of cavities 124 and 126 are in the form of blind holes. In another embodiment (shown in FIG.2A), at least one of cavities 124 and 126 are through holes formed in an associated one or more of securing members 103*b* and 103*c* to permit ends 128 and 130 of associated coupling member portions 104*b* and/or 104*c* to extend past the ends of the cavities during deflection of the coupling member in the manner described below.

Securing members 103*a*-103*c* may be formed integrally with body portion 102, by molding or other suitable means. Alternatively, the securing members may be formed as separate pieces and attached to the body portion using adhesives or other suitable means. Body member 102 may be formed from a metallic material, a polymeric material, or any other suitable material.

Figure 2:
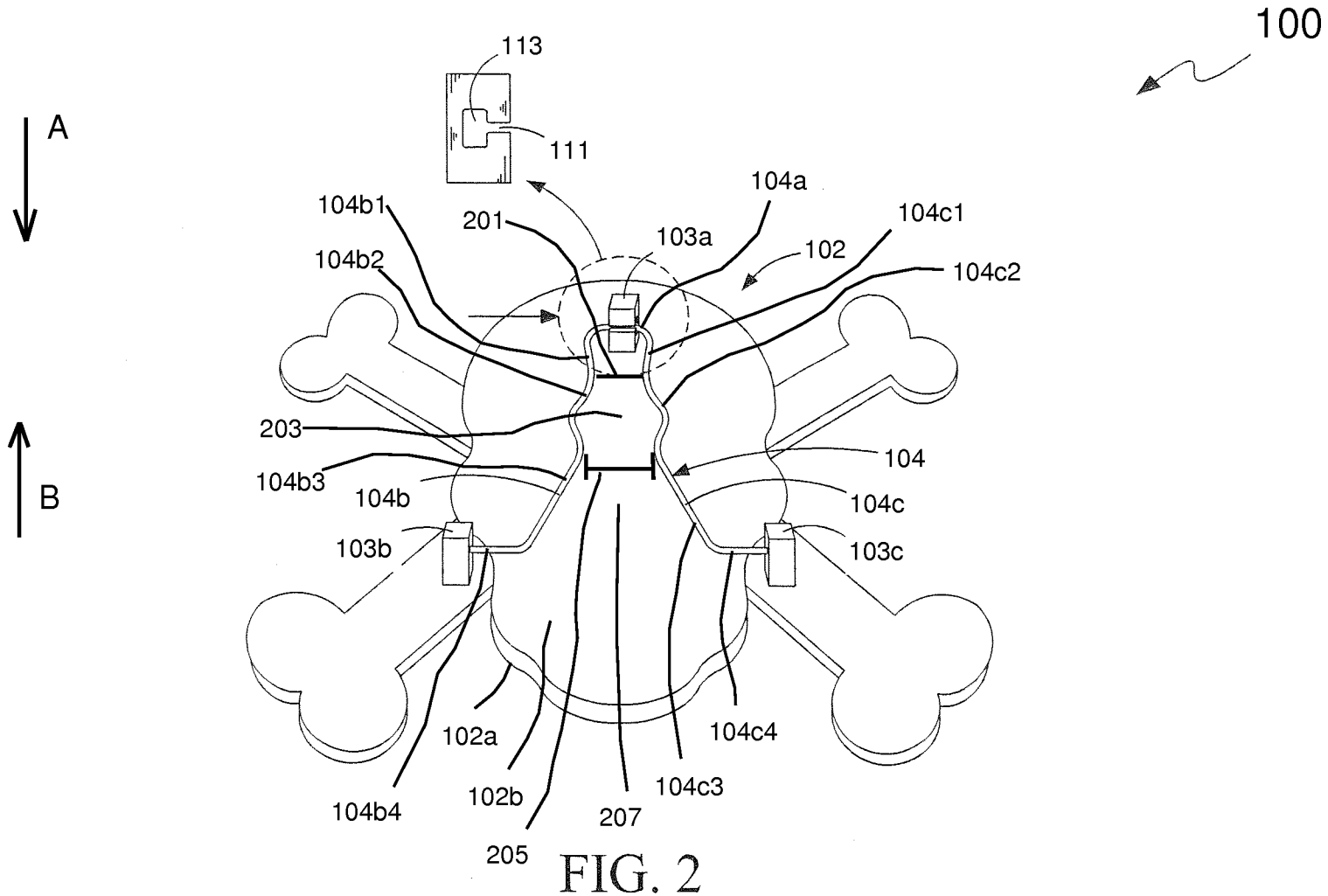
FIG. 2 is a rear view of the article of FIG. 1 showing a mechanism in accordance with one embodiment of the present invention for attaching the article of FIG. 1 to a button.
Figure 3:
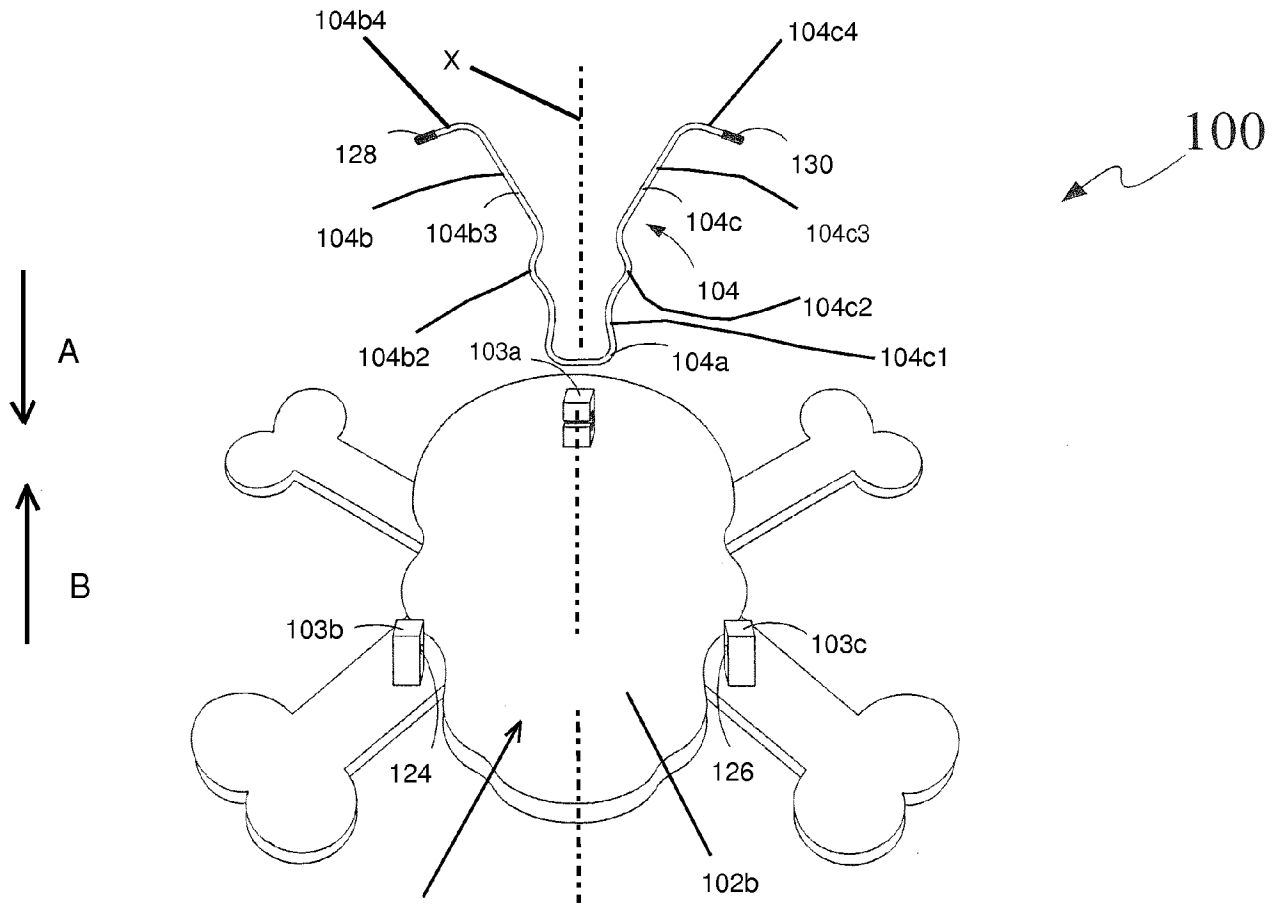
FIG. 3 is an exploded rear view of the article of FIG. 2.
Figure 3A:
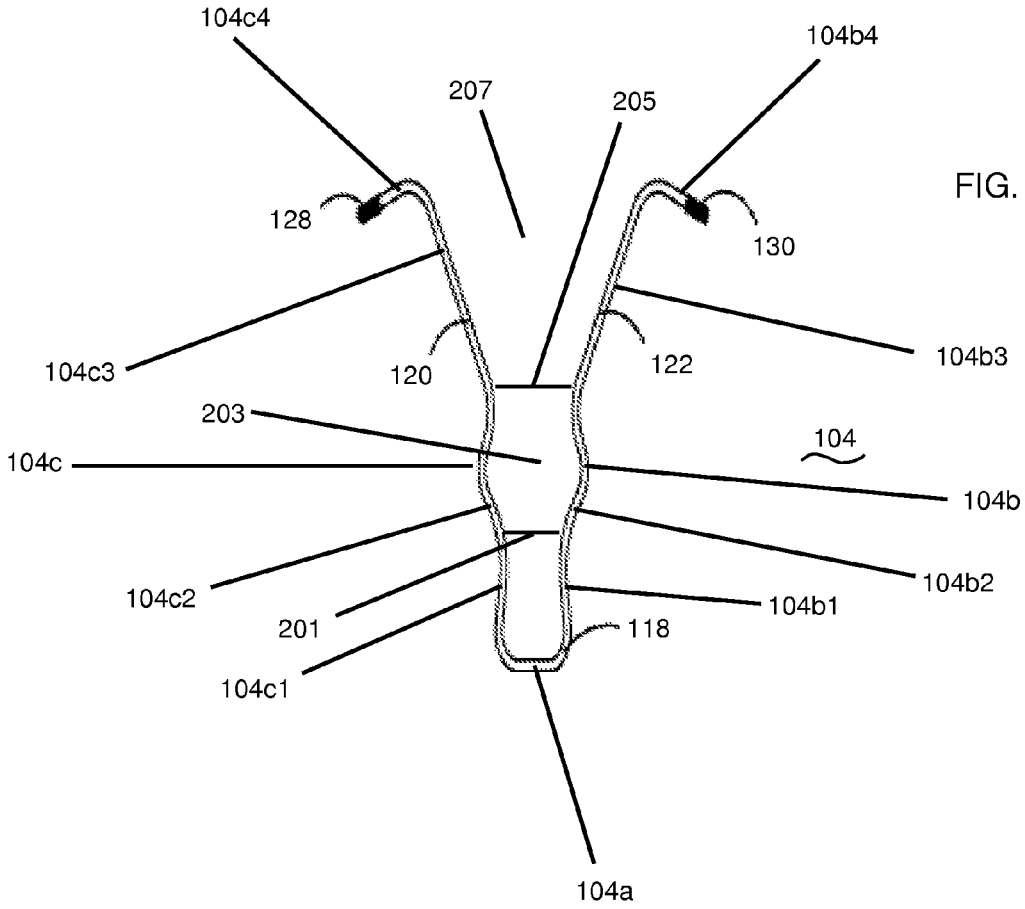
FIG. 3A is a plan view of a coupling member in accordance with one embodiment of the present invention.

Referring still to FIGS. 2, 3 and 3A, a coupling member or fastener 104 is attachable to body portion 102 to enable securement of the jewelry 100 to a button residing on an article of clothing. In the embodiment shown in FIGS. 1-4 and 7-13, coupling member 104 has a first portion 104*a* and opposed, resiliently deflectable second and third portions 104*b* and 104*c*, respectively, extending in a first general direction A from first portion 104*a*. In the embodiment shown, second and third portions 104*b* and 104*c* are structured so as to be symmetrical with respect to each other about an axis X bisecting first portion 104*a*.

As used herein, the terms "inwardly" and "inwardly extending" are used to refer to parts of second and third portions 104*b* and 104*c* that extend toward each other or tend to approach each other, or to instances where the second and third portions 104*b* and 104*c* deflect so as to approach each other. Similarly, the terms "outwardly" and "outwardly extending" are used to refer to parts of second and third portions 104*b* and 104*c* that extend away from each other, or to instances where the second and third portions 104*b* and 104*c* deflect away from each other.

Second portion 104*b* has a first segment 104*b*1 extending from coupling member first portion 104*a*, a second segment 104*b*2 extending from an end of the first segment, a third segment 104*b*3 extending from an end of the second segment, and a fourth segment 104*b*4 extending from an end of the third segment. Similarly, third portion 104*c* has a first segment 104*c*1 extending from coupling member first portion 104*a*, a second segment 104*c*2 extending from an end of the first segment, a third segment 104*c*3 extending from an end of the second segment, and a fourth segment 104*c*4 extending from an end of the third segment. In one embodiment, at least one of second segments 104*b*2 and 104*c*2 has a curved, arcuate, or circular configuration.

The junctions of segments 104*b*1 and 104*c*1 with segments 104*b*2 and 104*b*2 (where the ends of segments 104*b*1 and 104*c*1 join with segments 104*b*2 and 104*b*2, respectively) combine to define a gap 201 sized to be too narrow for a neck portion of a button to move into while the button jewelry is mounted on a button of a wearer. That is, the neck of the button will be too large to enter the gap 201 responsive to forces acting on the jewelry article due to gravity, inertia, or other forces resulting from simply wearing the jewelry article. The coupling member is structured so that such forces encountered during normal wearing of the jewelry article will be insufficient to force these junctions farther apart to a point where the button neck 900*a* may pass from cavity 203 through the gap 201. This structure of the coupling member aids in ensuring reliable positioning of the jewelry article with respect to the button.

In addition, segments 104*b*2 and 104*c*2 extend outwardly from respective ones of segments 104*b*1 and 104*c*1 as shown in FIGS. 1-4 and 7-13 to define a cavity 203 sized to receive the neck portion 900*a* of a button therein. Cavity 203 may be sized to receive button neck portions having any of a variety of different sizes, with clearance provided between the neck portion and at least one of segments 104*b*2 and 104*c*2. Also, the cavity 203 is sized to receive therein neck portions that are too large to fit through gap 201 defined by segments 104*b*1 and 104*c*1 as previously described.

The junctions of segments 104*b*2 and 104*c*2 with segments 104*b*3 and 104*c*3 (where the ends of segments 104*b*2 and 104*c*2 join with segments 104*b*3 and 104*c*3, respectively) combine to define a gap 205 sized to be too narrow for a neck portion of a button to move into while the button jewelry is mounted on a button of a wearer. That is, the neck of the button will be too large to enter the gap 205 responsive to forces acting on the jewelry article due to gravity, inertia, or other forces resulting from simply wearing the jewelry article.

The coupling member is structured so that such forces encountered during normal wearing of the jewelry article will be insufficient to force these junctions segments 104*b*1 and 104*c*1 farther apart to a point where the button neck 900*a* may pass from cavity 203 through the gap 205. This structure of the coupling member aids in ensuring reliable positioning of the jewelry article with respect to the button. That is, since the button neck 900*a* is confined to the cavity 203 while the jewelry article is being worn, the jewelry article 100 remains attached to the wearer and in a relatively fixed position on the wearer. In one embodiment, cavity 203 is also sized so as to prevent the head 900*b* of an inserted button from passing through the cavity.

Coupling member 104 may have any of a variety of alternative structures securable to body portion 102 and structured for deflecting and restraining a button neck in accordance with the principles described herein.

In addition, coupling member second and third portions 104*b* and 104*c* are resiliently deflectable such that one or both of the second and third portions 104*b* and 104*c* deflect outwardly responsive to forces exerted by the button neck 900*a* when the neck is inserted into the gap 205 by a user. As seen in FIGS. 1-4 and 7-13, coupling member third segments 104*b*3 and 104*c*3 taper outwardly from respective ones of second segments 104*b*2 and 104*c*2 to form a "lead-in" region or cavity 207 for the button neck 900*a*.

Coupling member 104 may be formed from a resilient metallic material or any other suitable material. Particular embodiments of the coupling member 104 contemplated herein are structured and formed from materials enabling the coupling member to be deflected as described herein for hundreds of cycles at least, while maintaining their resiliency and functionality. In one particular embodiment, the coupling member 104 is formed from 20 gauge music wire.

Referring again to FIGS. 1-4 and 7-13, to assemble the coupling member to the body portion 102, coupling member first portion 104*a* is inserted between the arms of first securing member 103*a* and into slot 111. It will be noted that other methods for rotatably securing coupling member first portion 104*a* to body portion 102 are also contemplated. The remainder of the coupling member (comprising coupling member second and third portions 104*b* and 104*c*) may then be rotated toward body portion 102. Coupling member second and third portions 104*b* and 104*c* are then manually of otherwise deflected inwardly to enable the end of segment 104*b*4 to be inserted into cavity 124 of securing member 103*b*, and the end of segment 104*c*4 to be inserted into cavity 126 of securing member 103*c*. The coupling member is now mounted on body portion 102 and ready for insertion of the neck portion of a button between coupling member portions 104*b* and 104*b*. When the coupling member 104 is secured to the body portion 102 in the manner described, the coupling member and the body portion define a cavity therebetween structured for receiving the head of a button therein when the button neck is inserted between coupling member portions 104*b* and 104*b*.

It will be noted that other methods for securing coupling member second and third portions 104*b* and 104*c* to body portion 102 are also contemplated.

Figure 10:
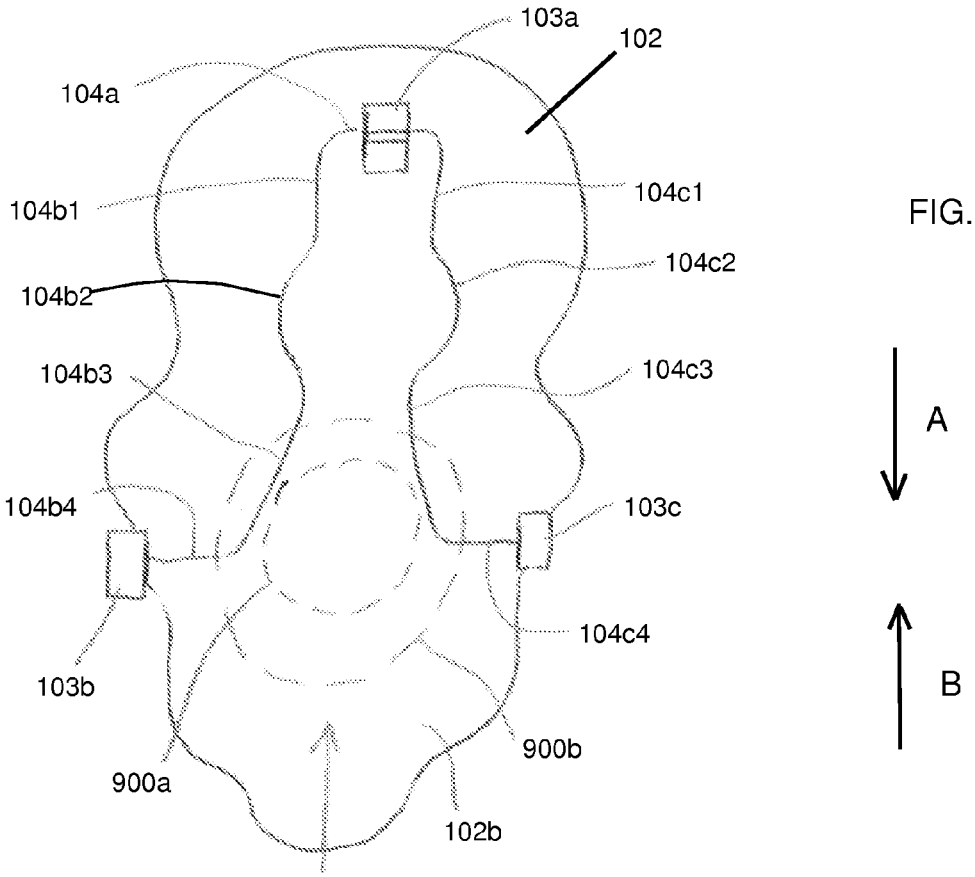
FIGS. 10-12 illustrate a sequence showing operation of the article of button jewelry during attachment of the article to a button.
Figures 11, 12:
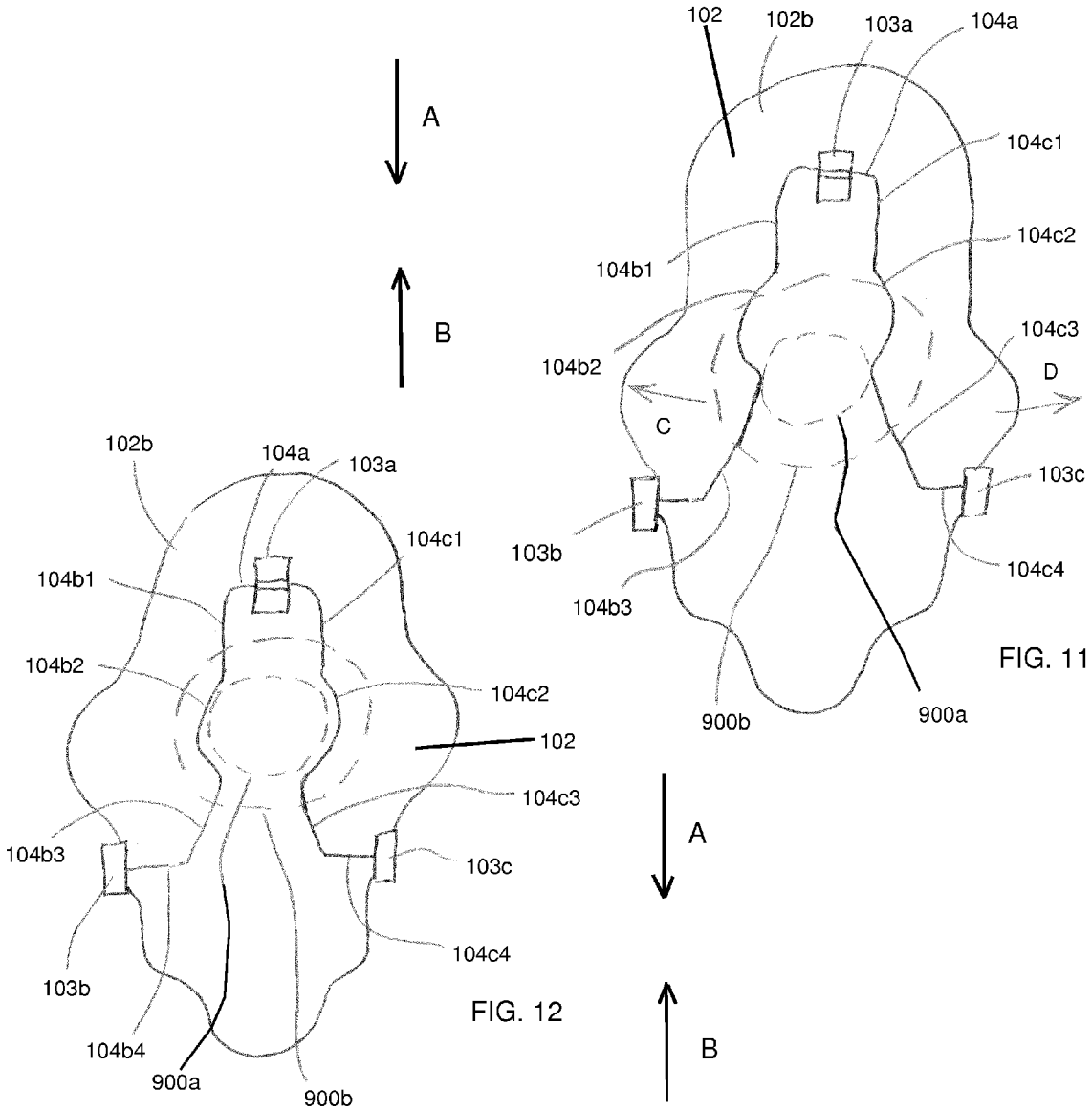
Figure 13:
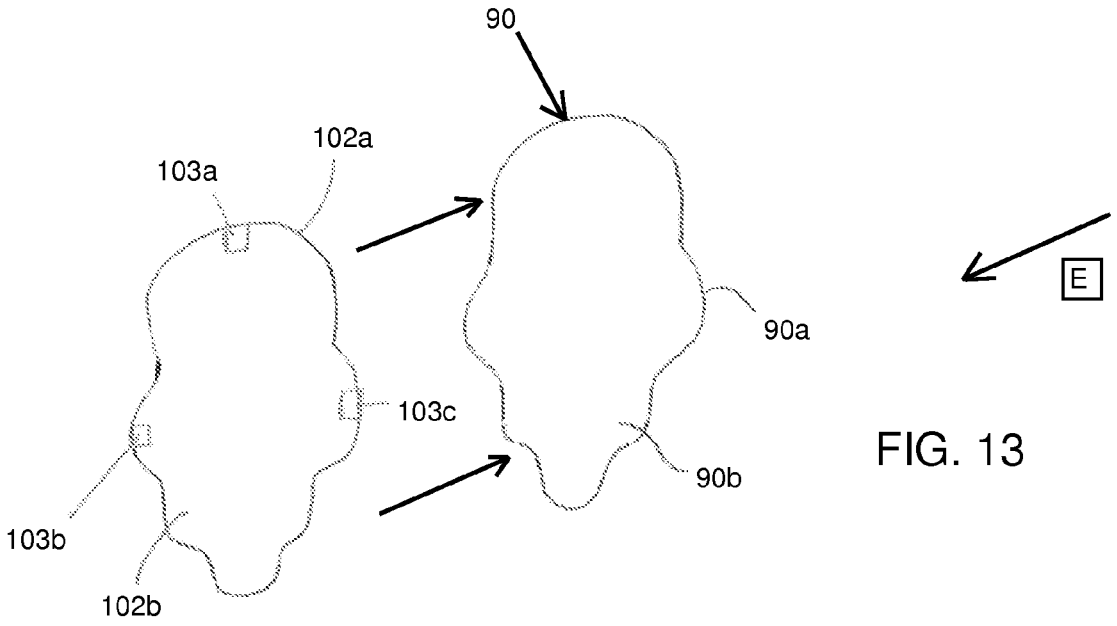
FIG. 13 is a perspective view showing attachment of a body portion to a front piece, in accordance with one embodiment of the present invention.

FIGS. 10-12 show mounting of the body portion 102 on a button 900. To mount the jewelry item 100 on a button, a user inserts the "head" portion 900*b* of the button between the coupling member 104 and body portion 102, and the neck portion 900*a* of the button into cavity 203, in the direction indicated by arrow "B" (as seen in FIG. 10). As the button neck 900*a* contacts the junctions between segments 104*b*2 and 104*b*3 and between 104*c*2 and 104*c*3 (FIG. 11), the forces exerted by the user resiliently deflect and force outwardly apart portions 104*b* and 104*c* at the junctions, in the directions indicated by arrows "C" and "D". This permits button neck 900*a* to enter cavity 203, whereupon the deflected regions of portions 104*b* and 104*c* snap back into an undeflected (or substantially undeflected) state. Ends 128 and 130 of coupling portion segments 104*b*4 and 104*c*4 may slide outwardly and inwardly within respective ones of cavities 124 and 126 during deflection and return of coupling member portions 104*b* and 104*c*.

As the gaps 201 and 205 are sized to prevent passage of button neck 900*a* through the gaps under normal use conditions, and as the coupling member portions 104*b* and 104*c* are structured to resist outward deflection due to forces applied by the button neck under normal use conditions, the button neck is secured in the cavity 203 until actively withdrawn by a user, by moving the jewelry article in the direction indicated by arrow "B".

In a particular embodiment, one or both of coupling member portions 104*b* and/or 104*c* are structured to permit sustained deflection while a button is received in cavity 203, and then return to an undeflected (or substantially undeflected) state when the button neck is removed from the cavity. This feature permits an "oversized" button neck to be inserted into cavity 203 and the jewelry article retained on the button without damage to the coupling member portions 104*b* and 104*c*.

Figure 2A:
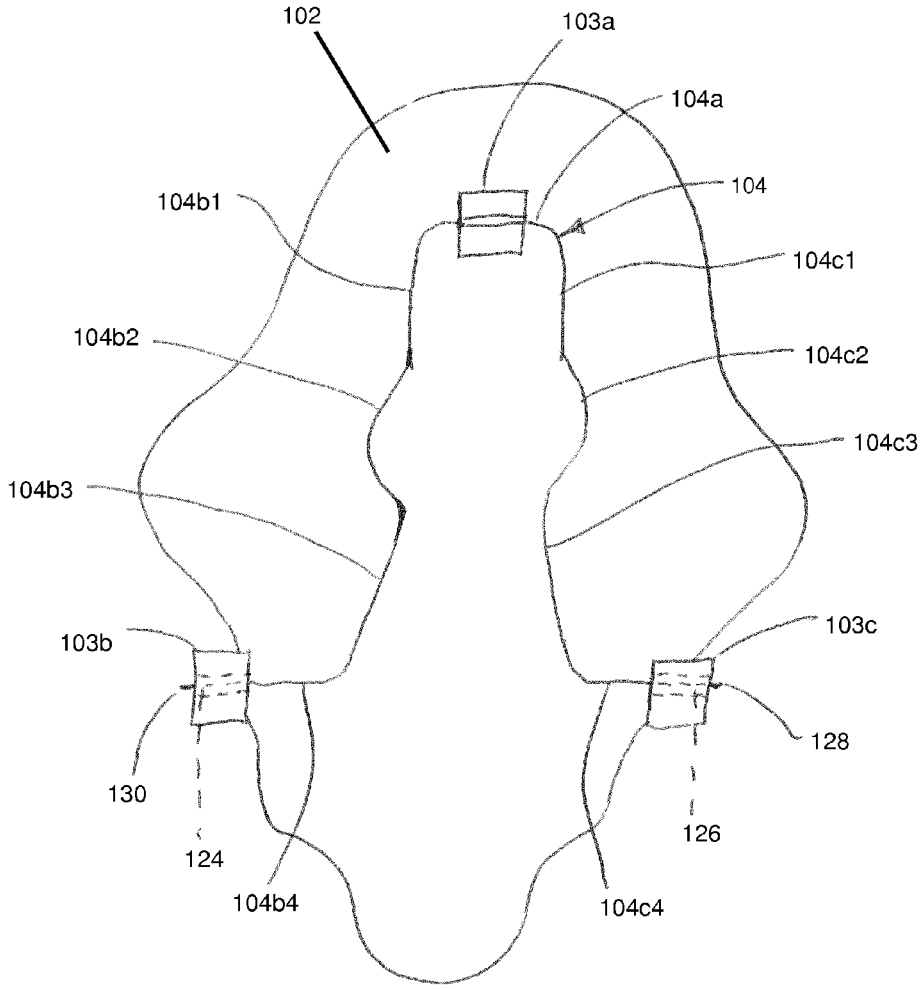
FIG. 2A is an alternative embodiment of the article shown in FIG. 2.

In a particular embodiment where cavities 124 and 126 are through holes and are open at both ends, the coupling member 104 may be structured so that ends of coupling member segments 104*b*4 and 104*c*4 may extend past outermost ends of the cavities as shown in FIG. 2A. This feature provides additional deflectability to the coupling member segments 104*b* and 104*c*, thereby enabling button necks having relatively larger sizes to be inserted into cavity 203.

It will be appreciated that the coupling member 104 and an associated body portion 102 may be made in a variety of sizes, so that a wide range of button sizes can be accommodated. This permits an article of jewelry mounted using the mechanism described herein to be used on a wide variety of clothing articles of different sizes, types, and configurations.

In addition, due to the resilient deflectability of the coupling member second and third portions 104*b* and 104*c*, these coupling member portions will deflect to receive and retain therebetween button necks having any of a wide variety of sizes, as long as the neck size is larger than the size of gap 205.

Figure 4:
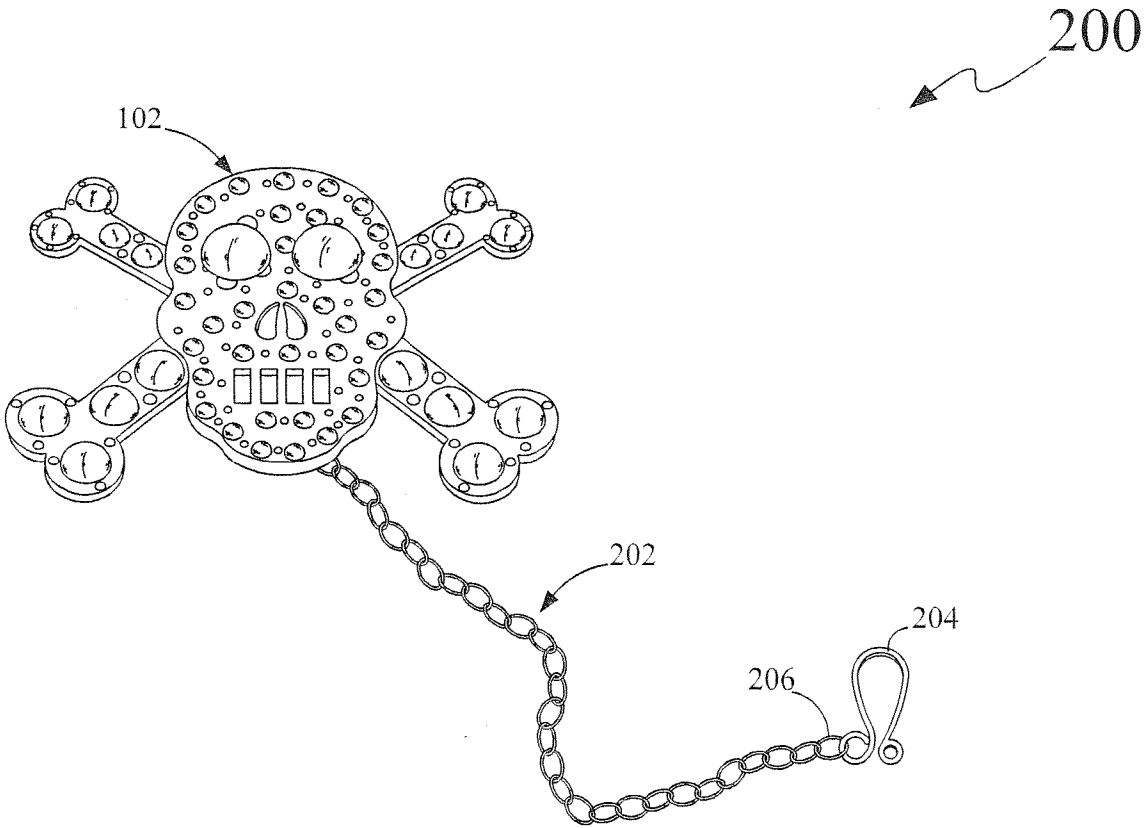
FIG. 4 is a perspective view of another embodiment of an article of button jewelry, showing the article including a chain and a clip carried by the chain.

Referring now to FIG. 4, another embodiment of button jewelry 200 may be similar to the button jewelry 100 of FIG. 1. However, the button jewelry 200 may further include a chain 202 ("chain 202") that may extend from and be carried by the body portion 102 through conventional fasteners, such as hooks, rings, and the like. Of course, the chain 202 may instead be coupled to other portions of the body portion 102 as desired. In addition, the chain 202 may be removably coupled to the body portion 102. The chain 202 may include an end portion 206 and a fastener 204 carried by the end portion 206. The fastener 204 may be adapted to couple to a portion of apparel such as, a belt loop, a pocket, and the like. The fastener 204 in this form may be a clip or a hook for securing the end portion 206 to the apparel to, for example, suspend the chain by the fastener 204 and the body portion 102. Of course, the fastener 204 may be other suitable fasteners. In addition, the fastener may have a design such as, a leaf, beads, and the like, to enhance an aesthetic appeal of the chain 202. Further, the chain 202 may be made of metal, plated with gold or silver, or made of various other materials.

Figure 7:
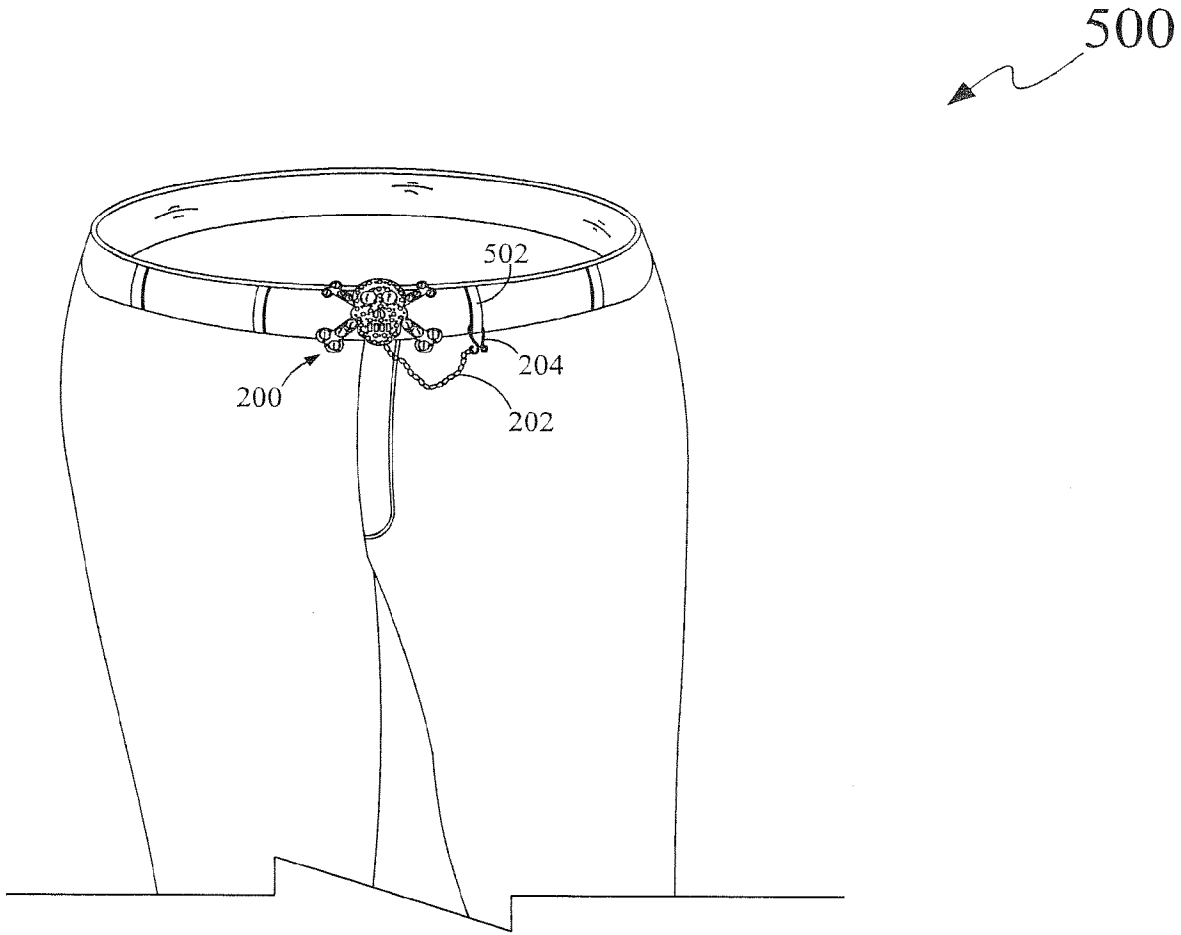
FIG. 7 is a perspective view of the article of FIG. 4, showing the article coupled to a button of apparel.
Figure 8:
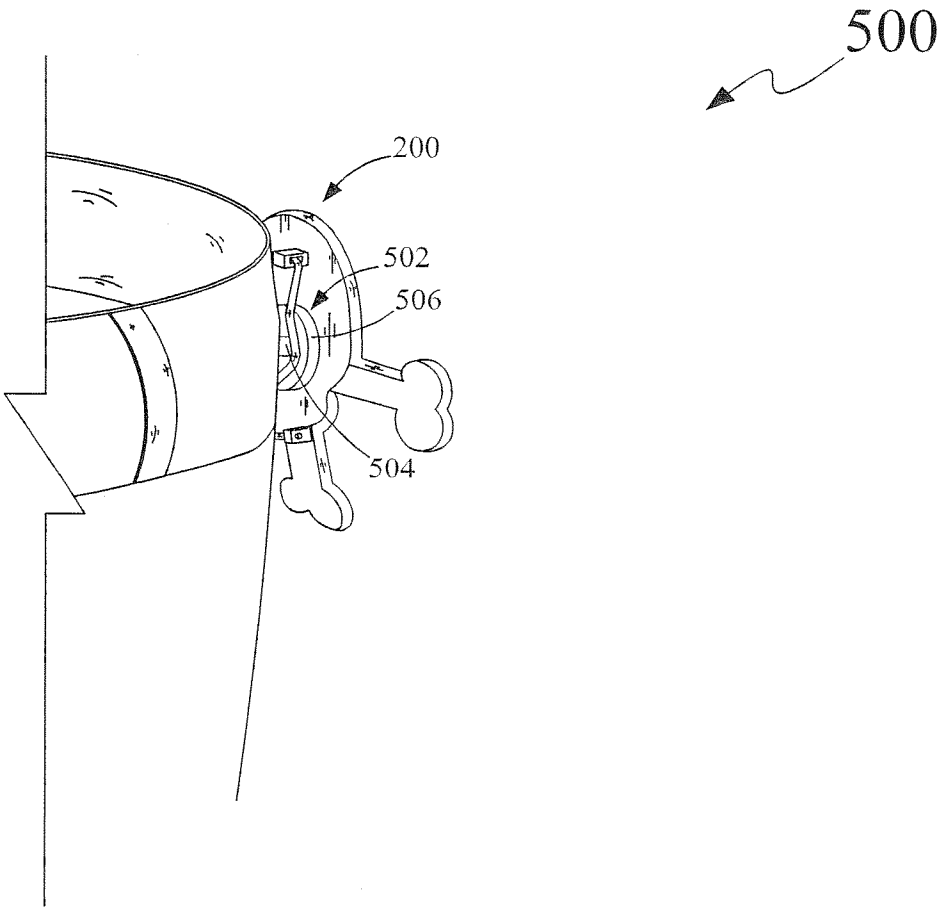
FIG. 8 is another perspective view of the article of FIG. 4, showing the article coupled to the button of the apparel.

Referring now to FIGS. 7 and 8, there is shown apparel 500 and the button jewelry 200 of FIG. 4, carried by the apparel 500. As best shown in FIG. 8, the apparel 500 may include a button 502 that may have a neck 504 and a head 506 extending from the neck 504. As described in conjunction with FIGS. 1-4 and 7-13, the fastener 104 may be slid over the button 502, such that the head 506 may be received between the fastener 104 and the body portion 102, and the neck 504 may be received between the first and second legs 104*b* and 104*c* of the fastener 104. Further, the clip 204 may be attached to the belt loop 508 of the apparel 500.

Figure 9:
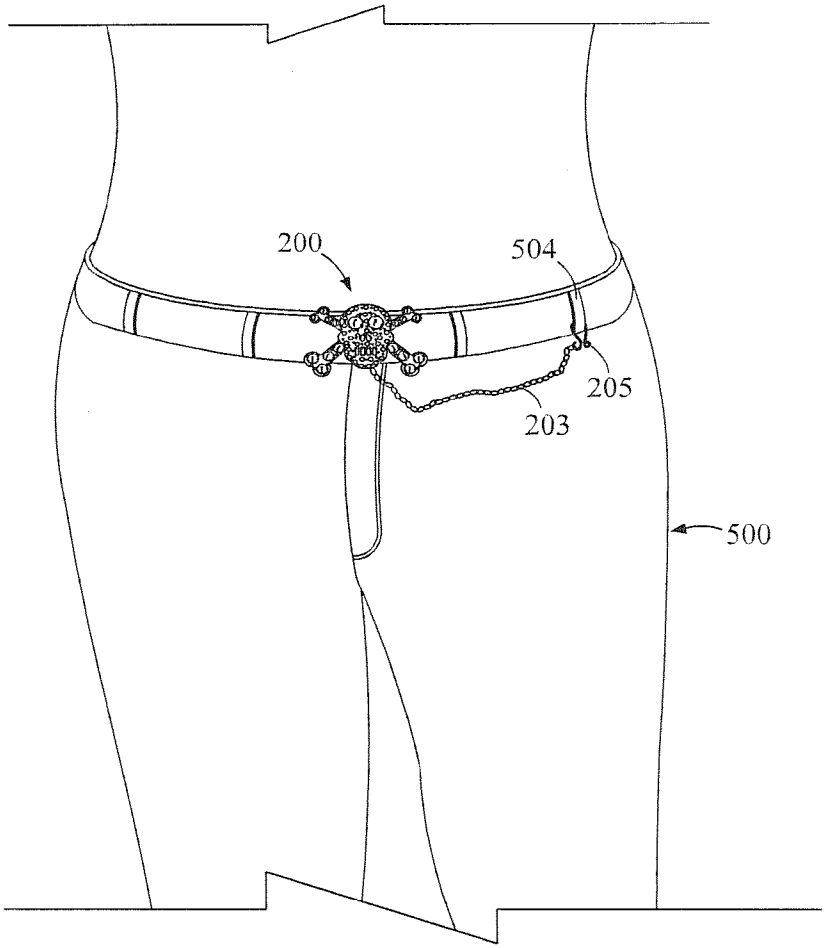
FIG. 9 is a perspective view of another embodiment of an article of button jewelry, showing the article having an elongated chain that wraps around a torso of an individual adorning the article.

Referring now to FIG. 9, another embodiment of button jewelry 200 may be similar to the button jewelry 100 of FIGS. 4 and 7. However, the button jewelry 200 may further include an elongated chain 203 ("Chain 203") that may be longer than the chain 202 of FIGS. 4 and 7, such that the chain 203 may partially wrap around the body of the clasp 205 may be fastened to a second loop rather than the first loop.

Figure 5:
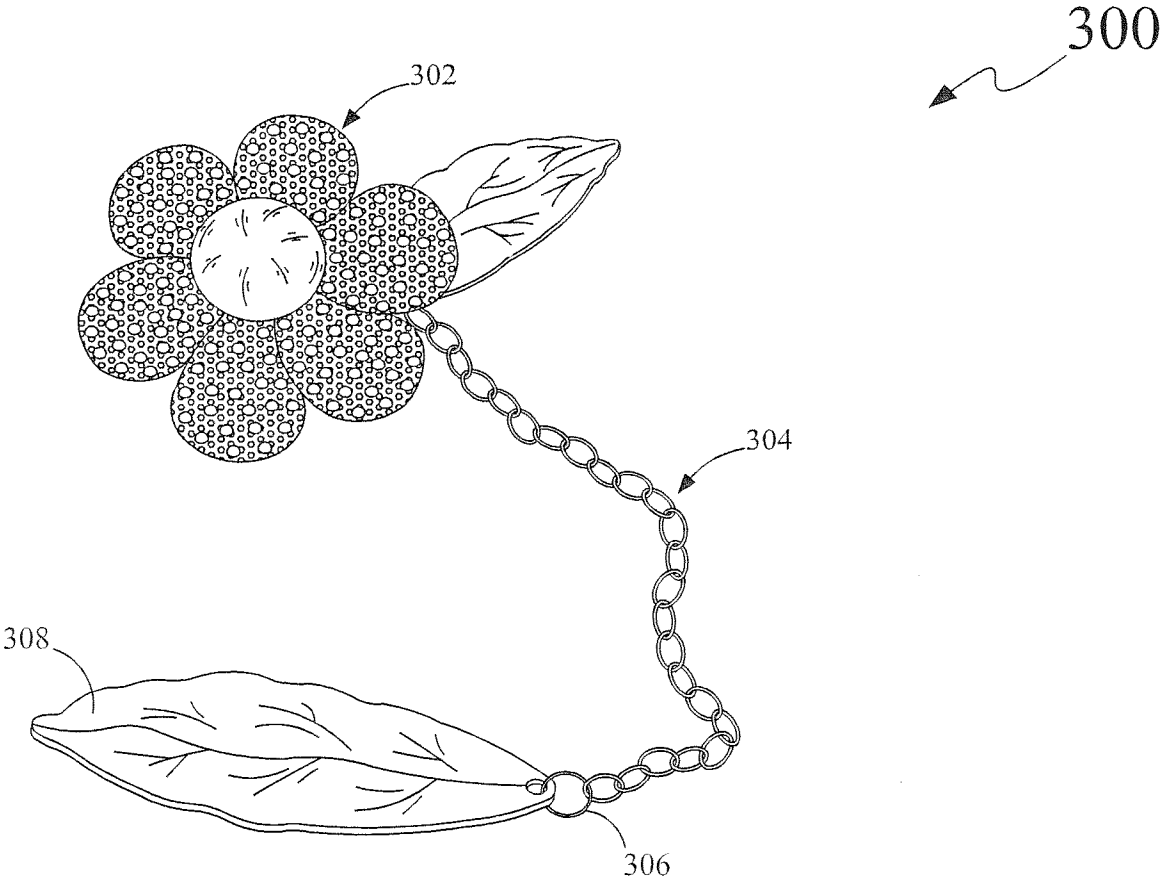
FIG. 5 is a perspective view of yet another embodiment of an article of button jewelry.

Referring now to FIG. 5, another embodiment of button jewelry 300 may include a body portion 302 and a chain 304 that may extend from the body portion 302. The body portion 302 may be shaped as a flower, have seats arranged in the pattern of the flower, and have stones received within those seats. In other respects, the body portion 302 may be similar to the body portion 102 of FIG. 1. Accordingly, for the sake of brevity, the body portion 302 is not described in detail. Further, the chain 304 may be similar to the chain 202 of FIG. 4. However, the chain 304 may have an end portion 306 including an anchor 308, which may have a shape of a decorative leaflet. The anchor 308 may be carried by a portion of the apparel, such that the chain 304 may be suspended by the body portion 302 and the anchor 308. For example, the anchor 308 in one form may be sized to be snugly received through a belt loop or within a pocket. The 30 anchor 308 may also include a rear surface (not shown) and a clip (not shown) carried on the rear surface (not shown). The clip may be attached to the loop of the apparel, a pocket of the apparel or other portions thereof.

Figure 6:
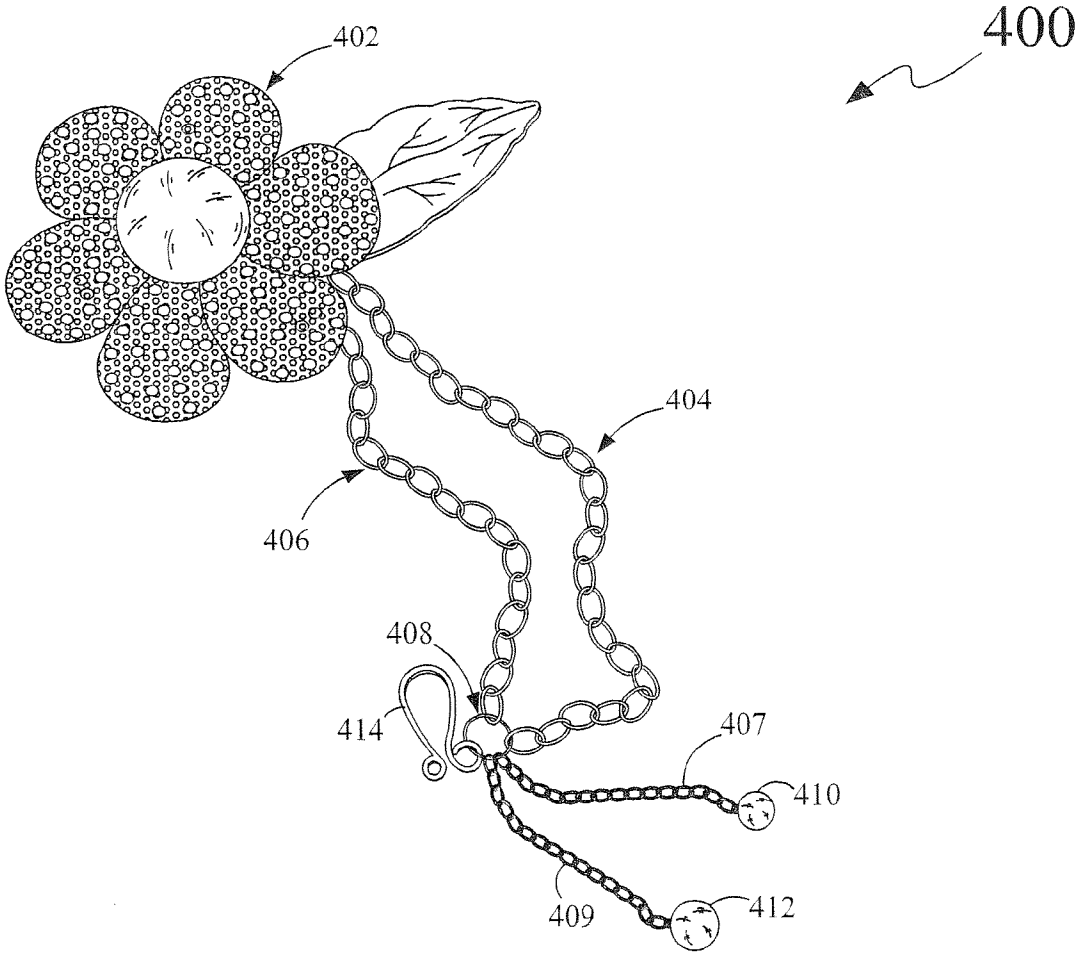
FIG. 6 is a perspective view of still another embodiment of an article of button jewelry.

Referring now to FIG. 6, still another embodiment of an article of button jewelry 400 may include a body portion 402 and a pair of chains 404, 406 that may extend from the body portion 402. Of course, the button jewelry may have more or less than two chains as desired. The body portion 402 is similar to the body portion 302 of FIG. 5. Accordingly, for the sake of brevity, the body portion 402 is not described in detail herein. The chains 404, 406 may have end portions 408 that may be adapted to unite together. The end portions 408 may include decorative accessories, such as chains 407, 409 and pearls 410, 412 suspended from a respective one of the chains 407, 409. Further, the end portions 408 may include further fasteners, such as a hook 414, for coupling the button jewelry 400 to a portion of the apparel, such as a loop or a pocket.

The articles of button jewelry and the attachment mechanism embodiments described herein may be beneficial for accessorizing apparel by covering a button of the apparel without creating the appearance of a large waistline. Furthermore, the attachment mechanism embodiments described herein enable the button jewelry to be removably attached to buttons on various outfits, including those that have loops and those that do not have loops.

The exemplary embodiments described herein detail for illustrative purposes are subject to many variations in structure and design. It should be emphasized, however, that the present disclosure is not limited to an article of button jewelry for covering a button of apparel as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms, "first," "second," and the like, herein do not denote any order, elevation or importance, but rather are used to distinguish one element with another. Further, the terms, "a" and "an" herein do not denote a limitation of quantity, but rather denote the presence of at least one of the referenced item.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. An article (100) for covering a button of apparel, the article comprising:

a body portion (102); and a coupling member (104) including a first portion (104*a*) and a pair of opposed resiliently deflectable second and third portions (104*b*, 104*c*) extending from the first portion (104*a*) and structured to outwardly deflect responsive to insertion of a neck (900*a*) of a button (900*b*) therebetween, each of the second and third portions (104*b*, 104*c*) terminating in an associated free end (128, 130), and wherein the coupling member (104) is secured to the body portion (102) such that each of a distal end of the first portion (104*a*) and the second and third portion free ends (128, 130) are secured directly to the body portion (102) during insertion of the button neck (900*a*) therebetween.

2. The article of claim 1 wherein the body portion (102) includes a pair of securing members (103*b*, 103*c*), wherein the second portion free end (128) is received in a first cavity (124) formed in an associated one (103*b*) of the pair of securing members, wherein the third portion free end (130) is received in a second cavity (126) formed in an associated other one (103*c*) of the pair of securing members, and wherein at least one of the first and second cavities (124, 126) is structured such that the associated one of the second portion and third portion free ends (128, 130) received therein is permitted to slide outwardly and inwardly within the at least one cavity.

3. The article of claim 1 wherein at least one of the first and second cavities (124, 126) is structured such that the associated one of the second portion and third portion free ends (128, 130) received therein is permitted to slide outwardly and inwardly within the at least one cavity during resilient deflection of the pair of opposed resiliently deflectable coupling member portions (104*b*, 104*c*).

4. An article for covering a button of apparel, the article comprising:

a body portion (102); and a coupling member (104) including a first portion (104*a*) directly attached to the body portion (102);

a pair of opposed first segments (104*b*1, 104*c*1) extending from the coupling member first portion (104*a*);

a pair of opposed arcuate second segments (104*b*2, 104*c*2), each second segment extending from an end of a respective one of the first segments ((104*b*1, 104*c*1);

a pair of opposed outwardly extending third segments (104*b*3, 104*c*3), each third segment extending outwardly from an end of a respective one of the second segments (104*b*2, 104*c*2);

a pair of opposed outwardly extending fourth segments (104*b*4, 104*c*4), each fourth segment extending outwardly from an end of a respective one of the third segments(104*b*3, 104*c*3), each of the fourth segments (104*b*4, 104*c*4) being attached directly to the body portion (102);

wherein the coupling member (104) is secured to the body portion 103) such that a distal end of the first portion (104*a*) and the second and third portion free ends (128, 130) are secured directly to the body portion (102) during insertion of the button neck (900*a*) therebetween.

5. The article of claim 4 wherein each of the fourth segments (104*b*4, 104*c*4) extends outwardly from an end of a respective one of the third segments (104*b*3, 104*c*3), in a direction perpendicular to a central axis (X) of the body portion (102).

6. The article of claim 5 each of the fourth segments (104*b*4, 104*c*4) extends outwardly from an end of a respective one of the third segments (104*b*3, 104*c*3) and into a separate associated securing member (103*b*, 103*c*), to attach the fourth segment to the body portion (102).

* * * * *

UNITED STATES PATENT AND TRADEMARK OFFICE

CERTIFICATE OF CORRECTION

PATENT NO. : 8,726,469 B1
APPLICATION NO. : 13/536984
DATED : May 20, 2014
INVENTOR(S) : Delaneau It is certified that error appears in the above-identified patent and that said Letters Patent is hereby corrected as shown below:

In the Specification

Column 5; Line 45; Delete "104b" and insert --104c--.

Column 5; Line 50; Delete "104b" and insert --104c--.

Signed and Sealed this
Sixteenth Day of December, 2014

Michelle K. Lee

Michelle K. Lee
*Deputy Director of the United States Patent and Trademark Office*